US011000713B2

(12) United States Patent
Sauerbier et al.

(10) Patent No.: US 11,000,713 B2
(45) Date of Patent: May 11, 2021

(54) METHOD FOR OPERATING A WORK APPLIANCE OR RESCUE APPLIANCE, WORK APPLIANCE OR RESCUE APPLIANCE, AND ENERGY SOURCE

(71) Applicant: LUKAS Hydraulik GmbH, Erlangen (DE)

(72) Inventors: Carsten Sauerbier, Lauf (DE); Tammy Horne, Gastonia, NC (US); Ian Cuba, Miami, FL (US); William J. Brown, The Villages, FL (US); Nick Ramirez, Ocala, FL (US); Uwe Kirchner, Marloffstein (DE)

(73) Assignee: LUKAS Hydraulik GmbH, Erlangen (DE)

( * ) Notice: Subject to any disclaimer, the term of this patent is extended or adjusted under 35 U.S.C. 154(b) by 163 days.

(21) Appl. No.: 16/081,395

(22) PCT Filed: May 6, 2016

(86) PCT No.: PCT/EP2016/060192
§ 371 (c)(1),
(2) Date: Aug. 30, 2018

(87) PCT Pub. No.: WO2017/190799
PCT Pub. Date: Nov. 9, 2017

(65) Prior Publication Data

US 2019/0083821 A1 Mar. 21, 2019

(51) Int. Cl.
*A62B 3/00* (2006.01)
*B25F 5/00* (2006.01)

(52) U.S. Cl.
CPC ..... *A62B 3/005* (2013.01); *B25F 5/00* (2013.01)

(58) Field of Classification Search
CPC .. B25F 5/00; A62B 3/005; F04B 35/04; F04B 49/06
See application file for complete search history.

(56) References Cited

U.S. PATENT DOCUMENTS 5,272,811 A * 12/1993 Armand ..... A62B 3/005 30/228
5,875,554 A * 3/1999 Vogelsanger ..... B23D 29/00 30/228

(Continued)

FOREIGN PATENT DOCUMENTS

DE 10 2014 218 475 A1 3/2016
EP 2 282 391 A2 2/2011

(Continued)

OTHER PUBLICATIONS

International Search Report and Written Opinion of the International Searching Authority for International Patent Application No. PCT/EP2016/060192 dated Jul. 4, 2016, 15 pages.

*Primary Examiner* — Andrew M Tecco
*Assistant Examiner* — Nicholas E Igbokwe
(74) *Attorney, Agent, or Firm* — Merchant & Gould P.C.

(57) ABSTRACT

A method is for operating an electromechanical or electrohydraulic work appliance or rescue appliance that can be carried and used by an operator, having a movable tool insert, a spreading tool or a lifting tool, a housing, an electric motor, a pump or a mechanical transmission driven by the electric motor, for actuating the tool insert. The appliance has an exchangeable, rechargeable appliance electrical energy source, having a housing in or on the rescue appliance. During operation of the appliance, operating data of the appliance and/or of the energy source are acquired and transferred into a data carrier or data storage device in the electrical energy source. The electrical energy source is removed from the appliance and connected to a charging (Continued)

Figure 1:
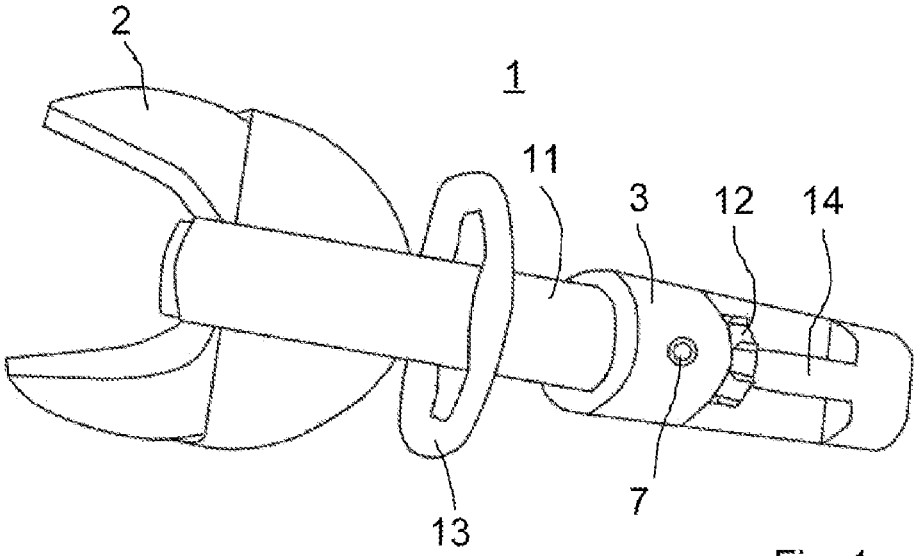

device. The operating data stored in the data carrier or storage device of the electrical energy source are read by the charging device and transferred to a network.

19 Claims, 8 Drawing Sheets

(56) References Cited

U.S. PATENT DOCUMENTS 5,953,822 A * 9/1999 Vogelsanger ..... B26B 15/00 30/228
7,568,372 B1 * 8/2009 Patton ..... A62B 3/005 72/453.15
7,982,624 B2 * 7/2011 Richter ..... B25F 5/00 340/626
2002/0120284 A1 * 8/2002 Schachar ..... A61F 2/147 606/167
2005/0017686 A1 * 1/2005 Sakakibara ..... G01R 31/392 320/132
2007/0085496 A1 * 4/2007 Philipp ..... A61B 17/32002 318/139
2011/0214471 A1 * 9/2011 Wettlaufer ..... B25F 5/005 72/332
2012/0267134 A1 * 10/2012 Matthias ..... H01M 2/1022 173/2
2012/0284981 A1 * 11/2012 Bungter ..... B21D 39/048 29/237
2013/0109375 A1 * 5/2013 Zeiler ..... H04W 12/1206 455/426.1
2013/0227843 A1 * 9/2013 Wason ..... B23D 21/04 30/247
2014/0055086 A1 * 2/2014 Malackowski ..... H02J 7/007 320/107
2014/0107853 A1 * 4/2014 Ashinghurst ..... G05B 15/02 700/297
2014/0151079 A1 * 6/2014 Furui ..... H02J 7/0042 173/46
2014/0158389 A1 * 6/2014 Ito ..... B25F 5/00 173/46
2015/0071791 A1 * 3/2015 Sauerbier ..... F04B 35/04 417/44.2
2016/0022374 A1 * 1/2016 Haider ..... A61B 17/142 606/96
2016/0363510 A1 * 12/2016 Kanack ..... G01M 99/008

FOREIGN PATENT DOCUMENTS

WO 2013/143606 A1 10/2013
WO 2013/187340 A1 12/2013
WO 2014/043190 A2 3/2014

* cited by examiner

METHOD FOR OPERATING A WORK APPLIANCE OR RESCUE APPLIANCE, WORK APPLIANCE OR RESCUE APPLIANCE, AND ENERGY SOURCE

This application is a National Stage Application of PCT/EP2016/060192, filed 6 May 2016, and which application is incorporated herein by reference. To the extent appropriate, a claim of priority is made to the above disclosed application.

The invention relates to a method for operating a work appliance or rescue appliance to a work appliance or rescue appliance, and to a chargeable electrical energy source for such a work appliance or rescue appliance.

TECHNOLOGICAL BACKGROUND

Portable, motor-driven work appliances or rescue appliances, of the type under consideration here, that can be carried by an operator are used in a multiplicity of applications. Thus, for example, there are cutting appliances, which are used by emergency services personnel (fire brigade) to rescue injured persons from vehicles involved in accidents or to free, for example, earthquake victims. The work appliances or rescue appliances in these cases vary greatly in type. There are electrohydraulically or electromechanically driven work appliances or rescue appliances having, preferably hardened, tool inserts for cutting, spreading or lifting. When in use, such appliances are subjected to extremely high mechanical demands and, depending on the place of use, are exposed to a very great variety of environmental influences (heat, cold, humidity).

At the same time, it is particularly important that rescue appliances, in particular, afford a particularly high degree of operational reliability when in use, since rescue operations must always be performed very rapidly. If, for example, a rescue appliance was exposed to adverse environmental influences (e.g. extreme heat) because of a prior deployment, this may have the result, for example, that seals in the region of the hydraulic lines have become damaged and, as a consequence, the operational fitness of the rescue appliance is no longer assured. When in use, this may have the result that the required performance of the appliance can no longer be achieved, e.g. owing to a resultant lack of tightness of seal, thereby impeding the rescue operation and consequently being to the detriment of the person to be rescued. Such appliances are thus used worldwide, and thus by a great variety of users.

PUBLISHED PRIOR ART

Known from WO 2014/043190 A2 are a system and a method for identifying an electromechanical work appliance that can be carried and used autonomously by an operator, according to the preamble of claim 1. Each of the work appliances has an individual ID for identifying the individual work appliance. In this case, a backup unit is connected to the work appliance, and comprises a sensor, a storage device, a transmission means and a controller. During the operation of the appliance, the sensor senses occurring vibrations that necessarily occur during operation and directly indicate use, the vibrations being converted by the controller into frequency data and transmitted by wireless communication to a central analysis site. From this, the frequency of the previous use can be deduced. This known system allows only an approximate sensing of the use of the work appliance, by means of the vibrations produced during use. Moreover, this system requires not insignificant appliance-specific adaptations.

OBJECT OF THE PRESENT INVENTION

The object of the present invention consists in providing a method of the generic type that, on the one hand, renders possible a more accurate monitoring of the operation of a work or rescue appliance and that, on the other hand, can be realized with a manageable degree of complexity in respect of equipment.

ACHIEVEMENT OF THE OBJECT

The method according to the invention makes it possible to compile, from direct operating parameters P1-Pn and not only direct criteria, an exact actuation and/or load profile of the work appliance or rescue appliance over time, and to manage these data centrally for the purposes of analysis. It thereby becomes possible to compile an individual "usage history" for each individual appliance on the basis of exact operating parameters that enable the manufacturer to implement individual, problem-specific service measures. For example, the individual user can be informed that, as a result of a previous increased demand on the appliance, there is a need for exceptional servicing to be performed very soon. The electrical energy source of the work appliance serves in this case as a "transmitter" of the collected operating data. Since the electrical energy source of the respective work appliance must be charged from time to time in any case, it is ensured, as it were, "automatically" that the data transmitted from the work appliance to the electrical energy source are reliably called up from the charging device and fed into the network. The call-up and transmission are effected automatically. Moreover, in comparison with known solutions, the complexity in respect of equipment for this can be simplified considerably to the selection of suitable storage means and data interfaces for transmission of the data via the electrical energy source. The operating data of a multiplicity of work appliances or rescue appliances can be collected and subjected to data analysis in the network, or in a central data collection site located therein. In this way, from a multiplicity of individual appliances, a history can be compiled in the data collection site in respect of the respective work appliance or rescue appliance. This history can be used to identify at any time whether servicing measures are to be performed sooner than is usual, for instance because of prolonged use in adverse operating conditions, or whether, for example, certain parts must be replaced. This history is also particularly important in respect of the assessment of cases of damage and claims, if it is necessary to provide proof of whether the work appliance or rescue appliance has been operated in a proper manner.

According to an expedient development of the present invention, the electrical energy source may also serve as a "courier" for transmitting data/programs from the network back to the individual work appliance or rescue appliance. The data and/or programs (e.g. a firmware update) for operating the work appliance or rescue appliance can thus easily be transmitted to the appliance via the electrical energy source, without the need for intervention by the user.

Expediently, each work appliance or rescue appliance comprises an appliance-specific ID that is a constituent part of the operating data. As a result, each individual appliance is given its own electronic identity, such that the operating data in the appliance can be assigned exactly during the analysis of the latter. Each appliance can thus be scanned and centrally analyzed.

Expediently, the operating data are, preferably direct, operating parameters. Preferably, the latter may be acquired in the form of physical measurement data (e.g. the current instantaneously drawn by the electric motor) and stored in an appropriate data format on a timeline, via an appropriate interface, in the electrical energy source.

According to an expedient development, the operating parameters are at least one operating parameter, or any combination of a plurality of operating parameters from the following group:

- the current drawn by the electric motor; this operating parameter can be used to deduce the force applied to the tool insert, and consequently the demand on the appliance;
- the voltage; this operating parameter can be used to deduce the power, or power output, of the appliance;
- the orientation of the work appliance or rescue appliance in space; this operating parameter can be used to deduce the operating conditions;
- the acceleration of the work appliance or rescue appliance in space; this can be used to deduce damaging mechanical influences such as, for example, impact effects;
- the charge state of the electrical energy source; this allows the user to be notified in good time of the need to change the battery;
- the number of charging cycles of the electrical energy source that have taken place; this makes it possible to predict the expected service life of the electrical energy source and, for example, to initiate measures in good time to replace the energy source;
- the ambient temperature; this enables the deployment of the respective appliance and the then prevailing ambient temperatures to be included in the history, for example to enable seals to be replaced in the event of the appliance having been exposed to considerable temperatures during use;
- the ambient humidity; this enables measures to be implemented selectively if the appliance has been exposed to considerable humidity or been in contact with water, resulting, for example, in impairment of electronic parts due to oxidation;
- GPS position coordinates; this makes it possible to include the respective location of the appliance to be included in the history and/or to compile an exact time log and documentation;
- the time; this enables other operating data to be placed in an exact time context.

Consequently, the invention makes it possible to construct an operating history, with a very great variety of data in each case, depending on the requirement, which enable a very precise assessment of the state and/or operating history of the individual appliance.

Expediently, the operating parameters are acquired on a timeline. The operating parameters, placed in a time relation or provided with a time stamp, can thus be subjected to an analysis. This makes it possible to assign operating parameters to a particular point in time or to a particular time period, and this, in turn, enables the operating history to be defined in an exact manner. The latter, in turn, allows exact determination of incorrect behavior during use, lateness in the performance of repair and servicing work, improper handling, and the like.

Preferably, the individual data arriving from the appliances are processed in the central data collection site, and a great variety of data records are created therefrom. Advantageously, the operating data are routed, as digitized, physical measurement data, or operating parameters, via the electrical energy source and the charging device, to the network, into the central data collection site. It is only there that the operating data undergo computational analysis and further processing. There is thus no need for any elaborate DP (data processing means) to be provided in the work appliance or rescue appliance itself for the purpose of further processing of the data. This can be performed, expediently, in the central data collection site.

Expediently, new data records can be generated in the central data collection site on the basis of the operating parameters. These records are, for example, the calculation of an individual service time point, a reminder message, a warning message concerning a detected or imminent malfunction, an error message, etc.

Expediently, the items of information, or data records, generated by the central data collection site are transmitted back to the individual work appliance or rescue appliance.

Expediently, this, in turn, may be effected via the charging device, or the electrical energy source, in the manner already described.

As an alternative or in addition to this, the information may also be transmitted to a DP device that is assigned to the individual work appliance or rescue appliance. For example, this may be a user's smartphone that is assigned to the user of the work appliance or rescue appliance, via an appropriate app. Consequently, information may be transmitted to the user's smartphone from the central data collection site, for example by short-range wireless communication (WLAN, WiFi, Bluetooth, etc.) and/or by mobile telephony connection. Alternatively or additionally, there may also be a corresponding display means on another user application, for example a headup display in the helmet.

Expediently, the exchange of data between the charging device and the network is effected by wireless communication, preferably by short-range wireless communication (such as, for example, WLAN, Bluetooth, WiFi, etc.).

According to a further expedient development of the method according to the invention, to enable meaningful information to be generated on the basis of the transmitted operating data, a computational analysis of the operating parameters is effected in the central data collection site, by comparison of the received operating parameters, or operating data, with the data of an empirical operating-parameter database.

Moreover, expediently, an appliance-specific operating history of the respective work appliance or rescue appliance, having the respective individual identity, can be generated in the data collection site on the basis of the operating parameters, and made available to the user.

The central data collection site additionally makes it possible to compile an experience database, in which information that is specific to the work appliance or rescue appliance can be input and/or called up by the user, wherein the experience database is generated in that users of the work appliance or rescue appliance input information data into the experience database, and the experience database can also be called up by users. This creates a further data information source, or the possibility of a comprehensive exchange of information that, on the one hand, can be used to assess the operating history of the appliances and, on the other hand, at the same time provides an additional benefit for the respective user.

Expediently, the central data collection site is a so-called computer cloud, which can be accessed via a network, preferably via the Internet. The computer cloud has the advantage that all computing tasks in respect of the further processing of the data relating to the operating parameters can be processed in the computer cloud.

The present invention additionally relates to an electromechanical or electrohydraulic work appliance or rescue appliance that can be carried and used autonomously by an operator, according to the preamble of claim 15. To achieve the object stated at the outset, the energy source has a data carrier or data storage device, in which the usage data of the sensor means can be stored.

Expediently, a data interface, preferably bidirectional, is provided between the work appliance or rescue appliance and the energy source. This may be a hardware interface such as, for example, a PCI bus, AGP, SCSI, USB or other firewall solution. Preferably, the processor of the work appliance, or rescue appliance, insofar as the processor is located in the latter, writes the data instantly to the data storage device of the electrical energy source via the interface. Alternatively, the processor could also be located in the electrical energy source.

Preferably, the interface is designed in such a manner that, during the insertion of the electrical energy source in the recess provided for this purpose on the work appliance and/or on the charging device, the data interface also simultaneously becomes active. Consequently, the data interface may be located in the region of the electrical contacting between the work appliance, or charging device, and the electrical energy source.

Expediently, a current sensor, a voltage sensor, a tilt sensor, a temperature sensor, a battery charge-state sensor, a battery charge-cycle counter, a GPS module and/or a humidity sensor is provided as sensor means. Expediently, a time recording means is provided. The GPS module has the advantage that, in addition to the location coordinates, it already includes a time recording means.

Expediently, the respective appliance comprises an analog/digital converter for the measurement signals corresponding to the operating parameters.

According to a further expedient development of the invention, the operating data and/or operating parameters and/or data records derived therefrom, thus, for example, the charge state of the energy source, etc., can be displayed directly, i.e. without being routed via the network, on a display assigned to the work appliance or rescue appliance, e.g. a headup display and/or a display disposed directly on the appliance and/or a display taken along by the user. The data in this case can preferably be transmitted directly to the display by a short-range wireless communication means of the work appliance or rescue appliance.

The present invention additionally comprises a chargeable electrical energy source for a work appliance or rescue appliance, according to at least one of claims 15 to 18, the energy source having a housing, at least one charge cell, preferably a plurality of charge cells, and an electrical contact region for electrical connection to the work appliance or rescue appliance or to the charging device. Additionally provided on the energy source are a data interface, preferably bidirectional, and a data carrier or data storage device, in which operating data of the work appliance or rescue appliance can be stored. These are data that, by means of sensors on the work appliance, pick up the operating data, or operating parameters, on the latter and store them in the data carrier, or data storage device, of the electrical energy source.

Expediently, a corresponding sensor may also be provided in the region of the battery itself, such as, for example, a battery charge-state sensor and/or a battery charge-cycle counter. The measurement values of the corresponding sensors are likewise read out via the data logger and transmitted to the data carrier, or data storage device, of the electrical energy source.

According to an expedient development of the present invention, in dependence on the respective data record, information corresponding to or generated concerning the latter is transmitted back to the individual work appliance or rescue appliance, from the central data collection site to the individual work appliance or rescue appliance. For example, if it is ascertained in the central data collection site that the individual appliance urgently requires replacement of seals because of exceptionally high loading in high ambient temperatures, this is transmitted back to the individual work appliance or rescue appliance and relayed, for example, to a display on the appliance. Alternatively, this may also be effected via an app, which displays the information, for example, on a portable computer, PC, smartphone or the like of the user.

DESCRIPTION OF THE INVENTION ON THE BASIS OF AN EXEMPLARY EMBODIMENT

Figure 2:
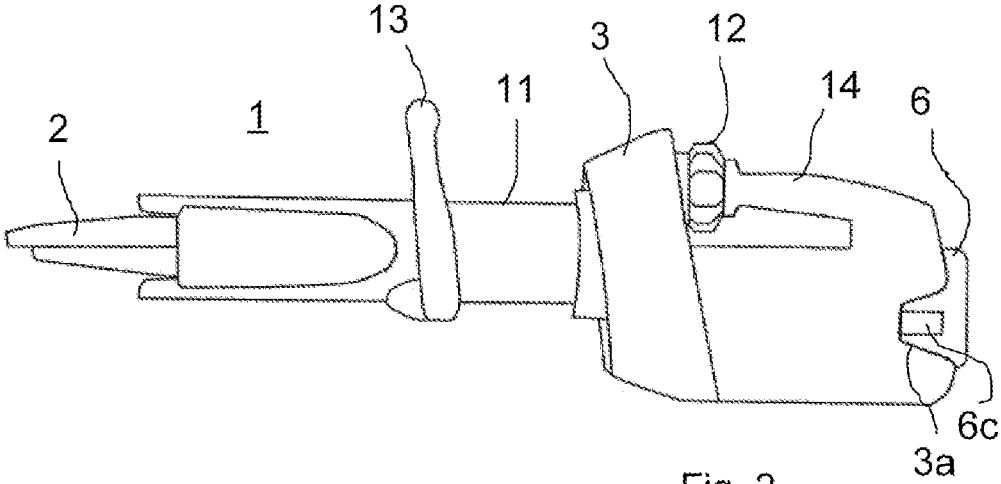
Figure 3:
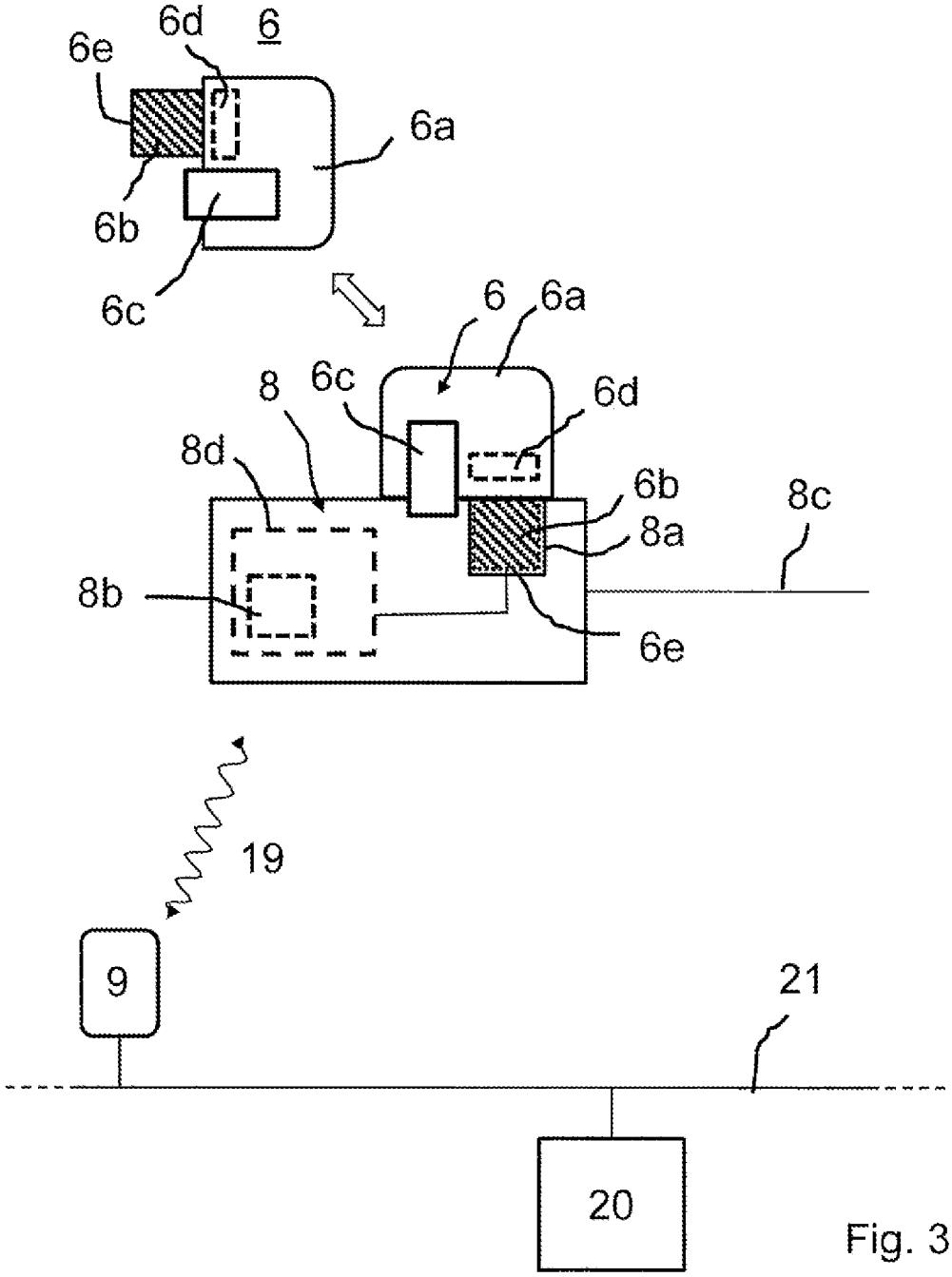
Figure 4:
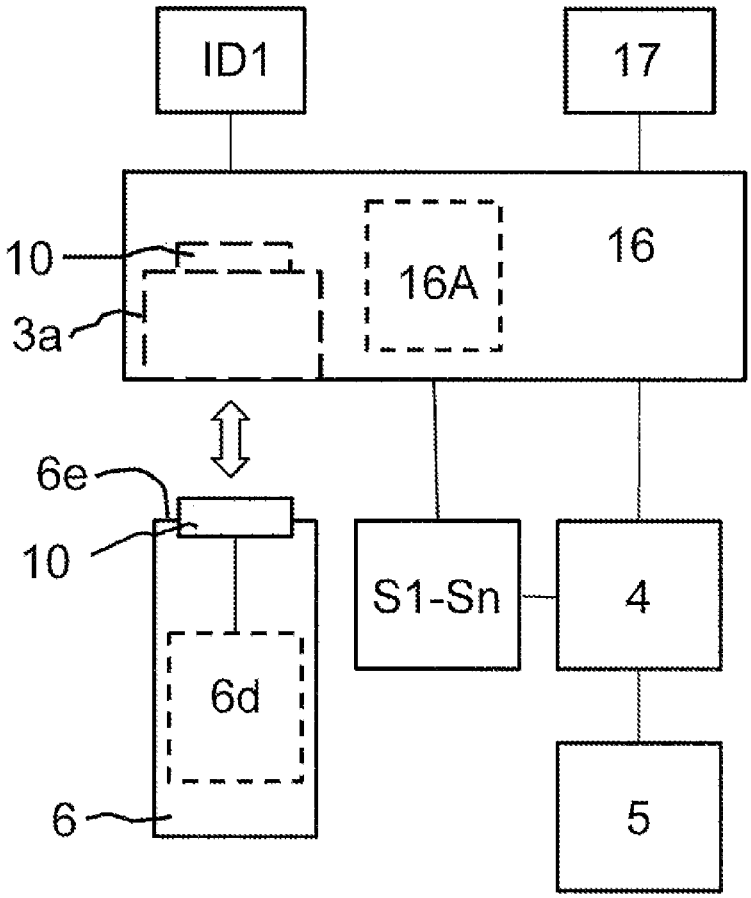
Figure 5:
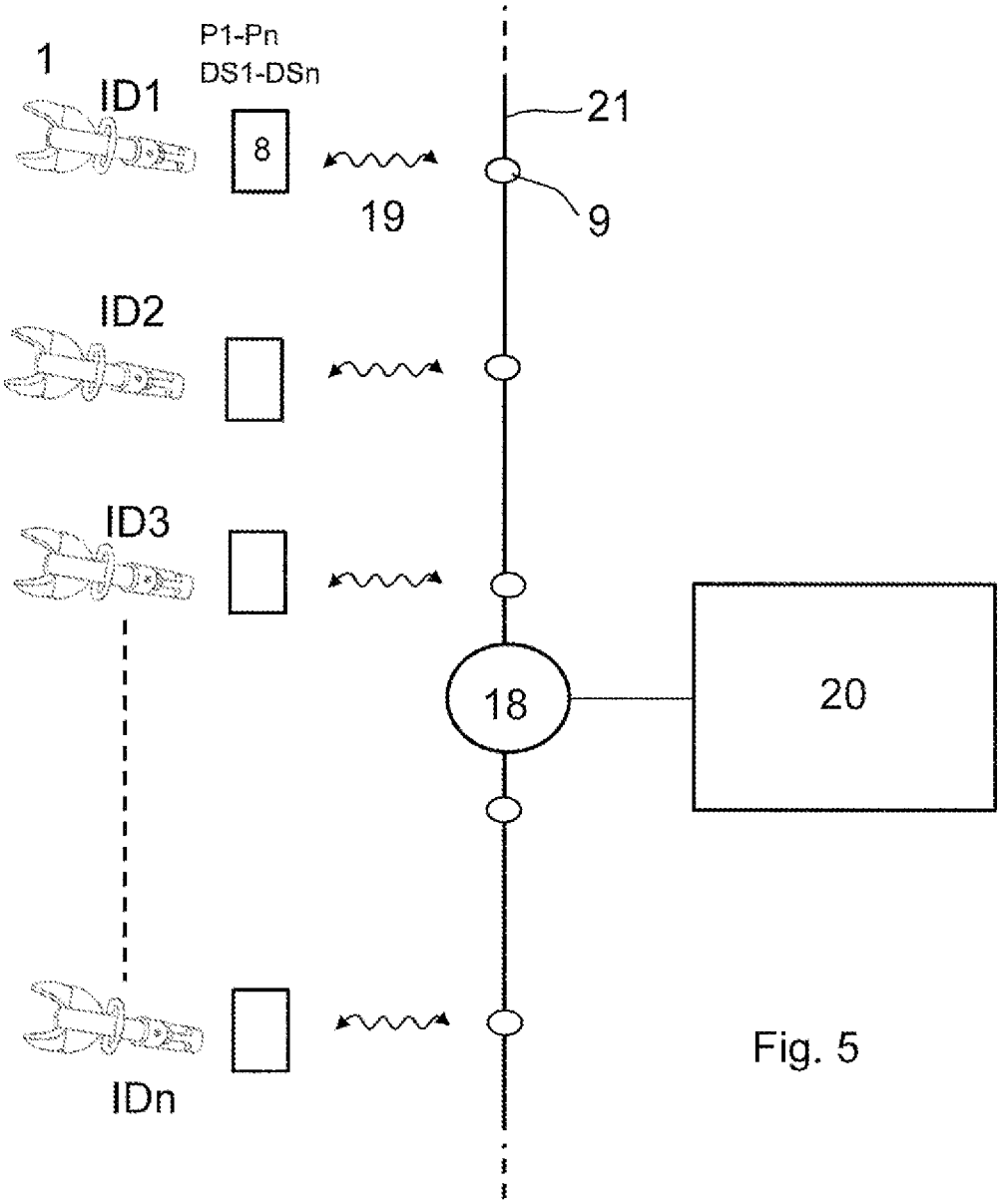
Figure 6:
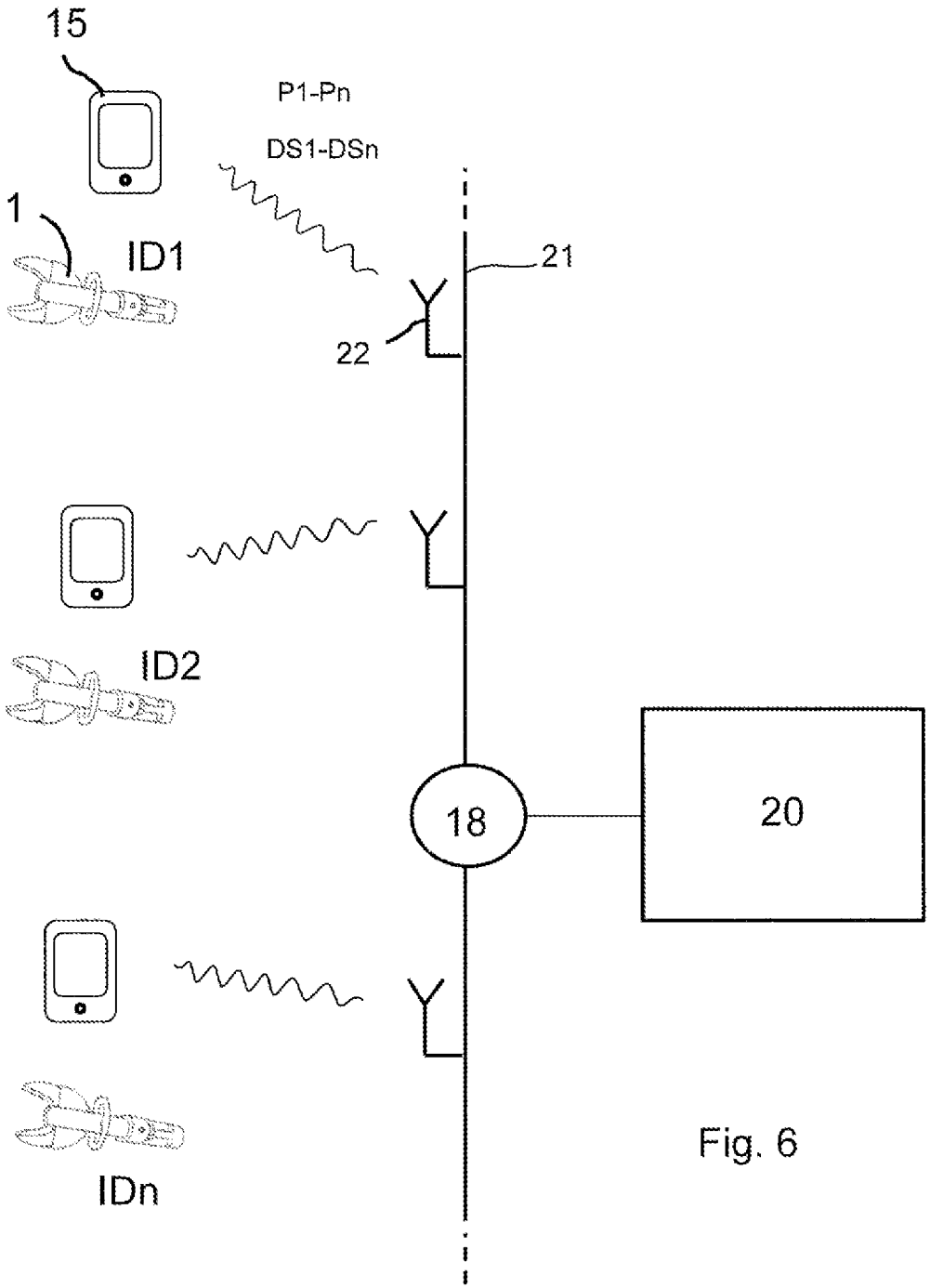
Figure 7:
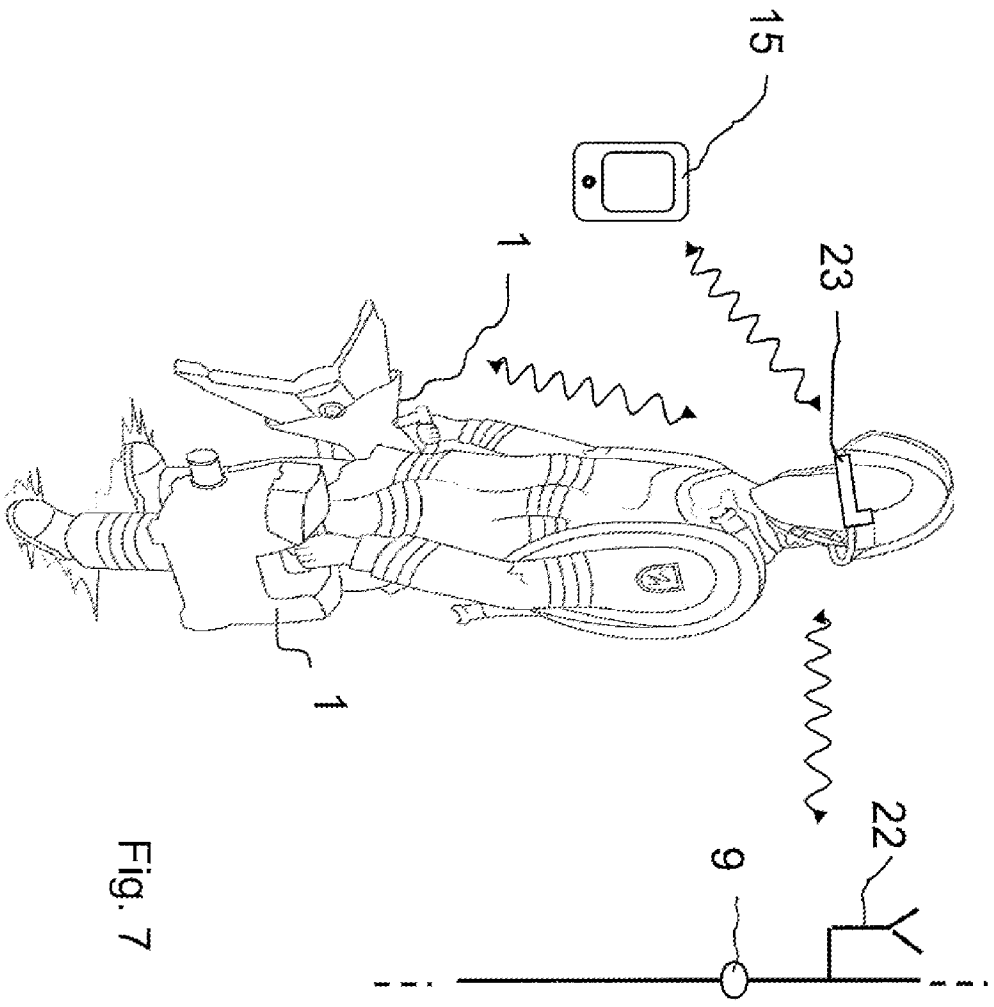
Figure 8:
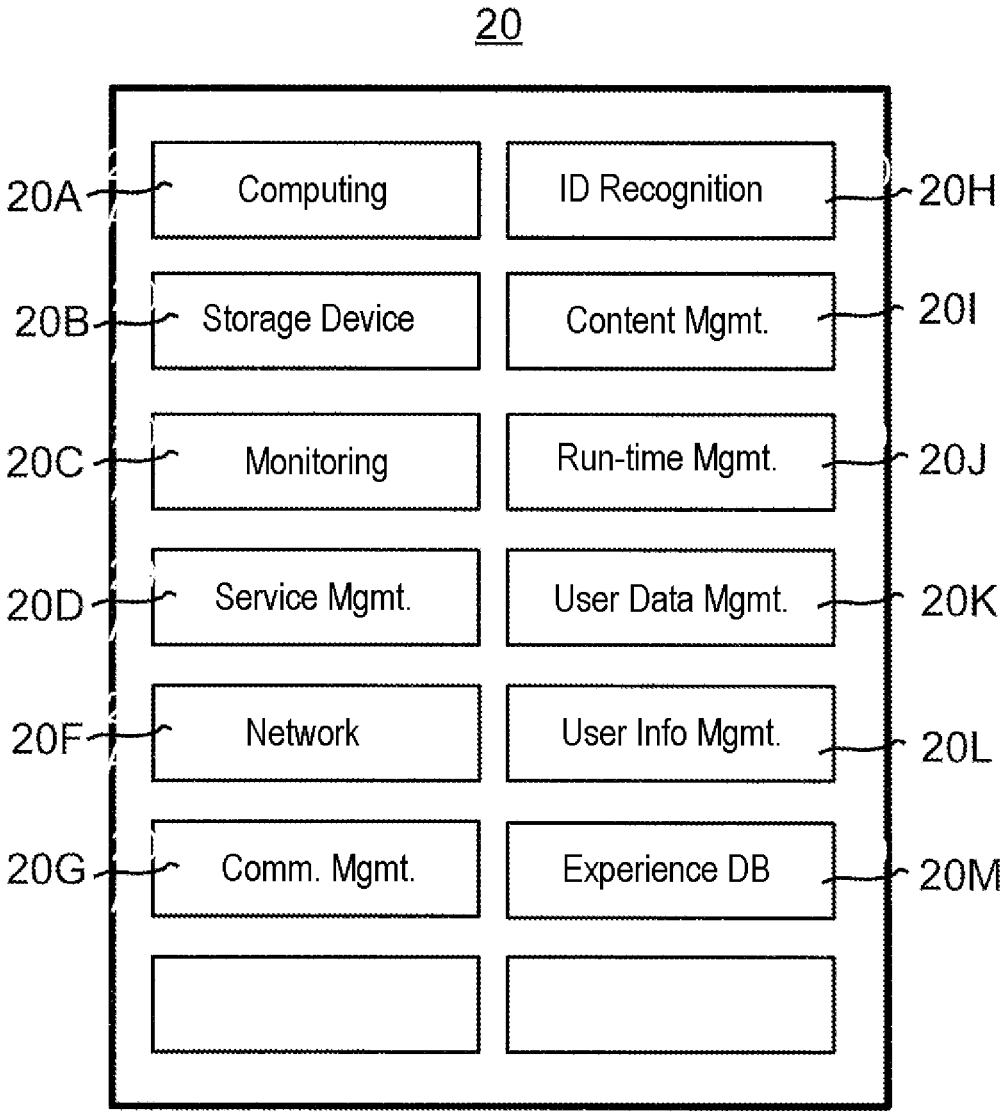
Figure 9:
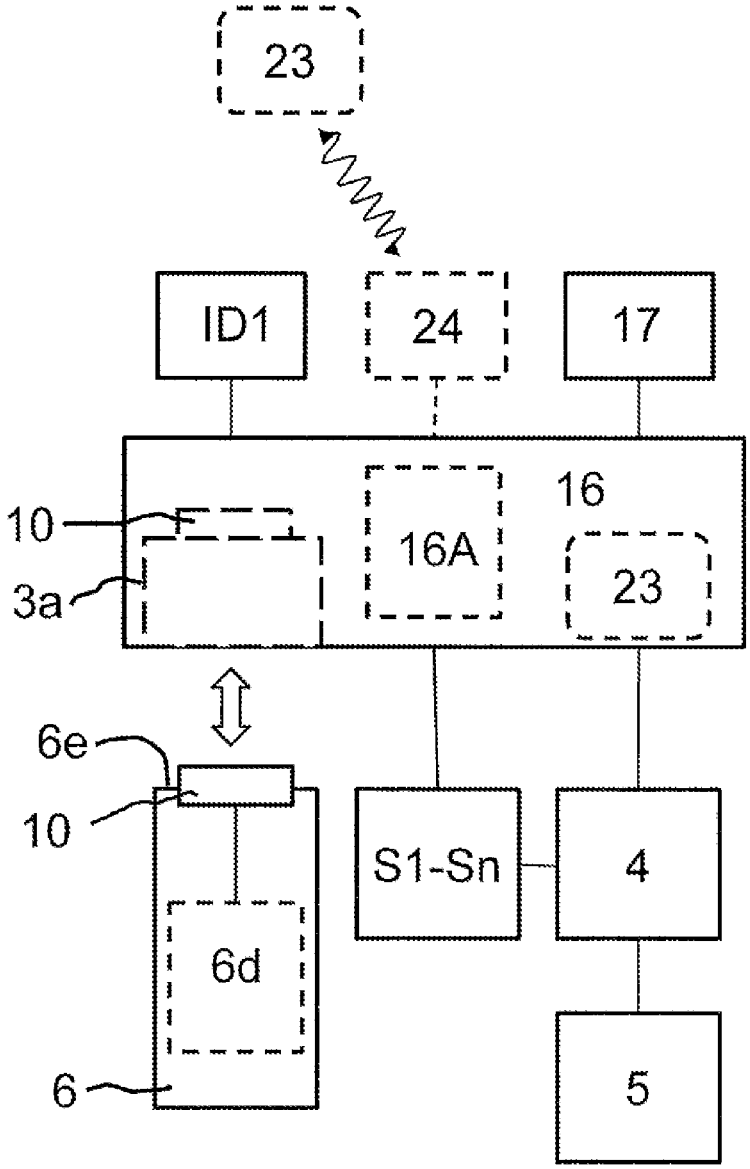

An expedient development of the present invention is explained in greater detail in the following. There are shown in:

FIG. 1 a rescue device for use in the method according to the invention, in a top view;

FIG. 2 the rescue appliance according to FIG. 1, in a side view;

FIG. 3 a highly simplified, schematic representation of the electrical energy source, the charging device with electrical energy source inserted, and the transmission of data from the charging device to a higher-order network;

FIG. 4 the functional units on the appliance, relating to the collecting of operating data;

FIG. 5 an example of a highly simplified, schematic structure of a configuration for sensing operating data for a central data site;

FIG. 6 an example of a highly simplified, schematic structure of a configuration for providing information of the central data site to the user of the individual work appliances;

FIG. 7 a deployed person with a headup display for receiving data of the central data collection site;

FIG. 8 a simplified example of an organization of the central data collection site, and FIG. 9 the functional units on the appliance, relating to the collecting of operating data, of a further development of the invention.

Reference 1 in FIG. 1 denotes an example of a work appliance or rescue appliance that can be carried and used autonomously by an operator. In the present case, this is an electrohydraulic cutter, which is frequently used as a rescue appliance by the fire service to free persons trapped in vehicles involved in an accident. The appliance comprises a housing 3, having a handle 14 and a switching valve 12, in the form of a rotary valve, that can be actuated manually. Reference 7 denotes a main switch on the housing 3. Adjoining the housing 3 there is a cylinder 11, disposed on which, likewise, there is a carrying handle 13. Disposed on the front of the cylinder 11 there is a tool insert 2, in the form of respectively two cutters of hardened material that, following actuation of the switching valve 12, move toward each other or away from each other.

Provided as an energy source 6 there is a storage battery, which can be inserted in a corresponding receiving slot 3*a* of the housing 3, as can be seen from FIG. 2. For the purpose of fixing the energy source 6 in the receiving slot 3*a* of the housing 3, the energy source 6 has holding clips 6*c*, disposed on both sides, that can be actuated by finger pressure to enable the energy source 6 to be withdrawn from the receiving slot 3*a*.

Inside the housing 3 there is an electric motor (not represented in FIGS. 1 and 2), which is provided to drive a hydraulic pump (likewise not represented in FIGS. 1 and 2). Actuation of the main switch 7 causes the electric motor, and consequently the pump, to be switched on or off. By means of the switching valve 12, an operator can operate the appliance either in a standby mode (no action upon the cylinder, the tool inserts 2 do not move) or in an operating mode (cutting mode, the tool inserts move toward each other; or opening mode, the tool inserts move away from each other).

According to FIG. 3, the energy source 6 comprises a separate housing 6*a*, having a housing projection 6*b*, in the region of which is provided the electrical contact region 6*e* for contacting to the appliance 1. The electrical energy source 6 additionally comprises a data interface (e.g. a USB interface), which is preferably likewise provided in the region of the housing projection 6*b* and connected to a data carrier, or data storage device, 6*d*. According to the invention, the data carrier, or data storage device, 6*d*, serves to receive operating data of the work appliance or rescue appliance 1, in order to hold it ready for a data export.

FIG. 3 furthermore shows the charging device 8, which is provided for charging the electrical energy source 6 and which has a receiving slot 8*a*, designed accordingly, for receiving the housing projection 6*b*. The charging device 8 comprises a data interface, which is compatible with the data interface of the energy source 6, and which enables the charging device 8 to access the data of the data carrier, or data storage device, 6*d* of the electrical energy source 6. An electrical connection and also a data connection are established upon insertion of the electrical energy source 6 in the receiving slot 8*a*. The charging device 8 furthermore comprises a charging cable 8*c*, a wireless communication module 8*b* and a dedicated processor 8*d*.

The wireless communication module 8*b* of the charging device 8 serves to transmit the operating data read out of the data carrier, or data storage device, 6*d* of the energy source 6, to a transmitting/receiving means (e.g. modem) of a network 21 (e.g. Internet), by means of a suitable communication protocol 19. The communication protocol is preferably a short-range wireless communication protocol (e.g. Bluetooth, WLAN, WiFi, etc.). Equally, an individualized wireless communication protocol or network of a non-standardized frequency band may also be used. As can be seen from FIG. 3, the energy source 6 thus serves as a "courier" or "transport means" for the operating data acquired by the work appliance or rescue appliance, to the higher-order network 21, via the charging device 8, from the work appliance or rescue appliance 1. The network 21 may be connected to a central data collection site 20, in which the operating data can be stored and/or processed further. The central data collection site 20 is preferably a so-called computer cloud, with which all further data processing operations and/or analyses can be performed on the basis of the transmitted operating data. In addition, data can also be stored there in large quantities.

As also shown by FIG. 3, the transmission of data between the charging device 8 and the transmitting/receiving means 9 may be bidirectional. It is thereby also possible to transmit data and/or programs (such as, for example, a firmware update) from the central data collection site 20, via the network 21 and the transmitting/receiving means 9, to the charging device 8, and from the latter back to the electrical energy source 6. For example, this enables a firmware update to be easily performed on the work appliance or rescue appliance 1 as the energy source 6 is being charged, without intervention by the user.

FIG. 4 shows, in a highly simplified, schematic representation, the individual functional units of the work appliance or rescue appliance 1 that are associated with the acquisition of operating data. The electric motor 4 drives the hydraulic pump 5, which, in turn, causes hydraulic fluid to be delivered to the hydraulic cylinder 11, either on the piston side (working mode) or piston rod side (opening mode) thereof. The energy source 6 supplies electrical energy to the electric motor. For reasons of clarity, in FIG. 4 the electrical energy source 2 is not shown as having been inserted in the receiving slot 3*a*. The data interface 10 (e.g. a USB interface) is also positioned in the region of the electrical contact region 6*e* of the energy source.

Reference 16 denotes a processor for controlling the operation of the work appliance or rescue appliance 1. S1-Sn denotes at least one sensor means, preferably a plurality of sensor means, by which at least one operating parameter P1-Pn of the appliance is acquired. These operating parameters P1-Pn, acquired by the respective sensor means S1-Sn, are read out by a data logger 16A. In this case, preferably physical measurement values of the respective sensor means S1-Sn are converted into an appropriate data format, and written by the processor 16, via the data interface 10, into the data carrier, or data storage device, 6*d* of the energy source 6.

Expediently, the sensor means are a means for measuring the current and/or the voltage drawn by the electric motor 4, and/or the charge state of the energy source 6, and/or the charge cycles of the energy source 6, and/or the ambient temperature, and/or the ambient humidity.

In FIG. 4, the energy source 6 is represented in the withdrawn state. For the purpose of connection, the energy source 6 is inserted in the receiving slot 3*a*, as a result of which the data interface 10 next to the electrical contact region 6*e* becomes active. As a result, when the energy source 6 has been inserted, on the one hand the work appliance or rescue appliance is supplied with electrical energy, and on the other hand the data interface 10 enables the processor 16 to write the operating data, or operating parameters, collected via the data logger 16*a*, into the data carrier, or data storage device, 6*d*.

Expediently, the work appliance or rescue appliance 1 comprises a GPS module 17 that, on the one hand, comprises a time module, by which the operating data can be provided with a time coordinate, and on the other hand allows position coordinates to be transmitted as part of the operating data, and analyzed with the latter, if required.

The operating parameters are at least one operating parameter or a combination of operating parameters from the following group:

- the current drawn by the electric motor; this operating parameter can be used to deduce the demand on the appliance, the load and/or loading on the appliance or parts thereof (e.g. tool inserts);
- the voltage; this operating parameter can be used to deduce the power, or power output, of the appliance;

the orientation of the work appliance or rescue appliance in space; this can be used to identify particular operating conditions;

the acceleration of the work appliance or rescue appliance in space; this can be used to deduce mechanical influences such as, for example, impact effects and/or vibration effects;

the charge state of the electrical energy source; this allows the user to be notified in good time of the need to change the battery;

the number of charging cycles of the electrical energy source that have taken place; this makes it possible to predict the expected service life of the electrical energy source and, for example, to initiate measures in good time to replace the energy source;

the ambient temperature; this enables the deployment of the respective appliance and the then prevailing ambient temperatures to be included in the history, for example to enable seals to be replaced in the event of the appliance having been exposed to very high temperatures during use;

the ambient humidity; this enables measures to be implemented selectively if the appliance has been exposed to considerable humidity or been in contact with water, resulting, for example, in impairment of electronic parts due to oxidation;

GPS position coordinates; this makes it possible to include the respective location of the appliance in determination of the history;

the time; this enables other operating data to be placed in an exact time context.

Furthermore, each appliance has an appliance-specific, individual identity ID1-IDn. This individual identity ID may be defined, for example, by a consecutive binary number.

It is pointed out that the representation of the individual functional elements in FIG. 4 is merely schematic and, clearly, the specific arrangement may vary.

FIG. 5 shows, in a highly simplified, schematic representation, a plurality of work appliances or rescue appliances 1 in use, having differing individual IDs. According to the invention, the operating parameters P1-Pn, or data records DS1-DSn derived therefrom, of each individual appliance 1 are transmitted, via the communication protocol 19, from the charging device 8 of each appliance ID1-IDn to an associated data receiving means 9. The communication protocol 19 is preferably Bluetooth, WiFi or WLAN. These types of communication protocol have the advantage that they require comparatively little electrical energy.

Via a network provider 18, the data are stored in the central data collection site 20 and/or processed further. In this way, all operating parameters P1-Pn of all individual appliances ID1-IDn world-wide can be stored in the central data collection site 20 and held ready for analyses. A usage history for each individual appliance can thus be stored in the central data collection site 20.

As shown by FIG. 6, the operating parameters P1-Pn, or data records DS1-DSn, can be transmitted from the central data collection site 20, via the network 21, to data processing devices 15 of users, for example smartphones, tablets, notebooks, etc., in order to inform the respective user about the current state of the user's work appliance or rescue appliance 1. These data are transmitted, for example, via a mobile telephony network 22. Each user of an individual work appliance or rescue appliance having the identity ID1-IDn thus receives individual data and/or information relating to the user's appliance.

This makes it possible, for example as represented in FIG. 7, for corresponding data to be displayed, even during deployment, on an appropriate display device, which, in the case of the representation according to FIG. 7, is a headup display 23 in the helmet of the user. The data in this case may be transmitted either directly by the mobile telephony network 22, or by a short-range wireless communication network 9 (e.g. Bluetooth, WLAN, WiFi or the like), from the data processing device 15 or from the appliance 1, directly to the display device, i.e. the headup display 23. In this way, the user has all necessary information in their field of view during the deployment.

Alternatively, the information may also be transmitted from the user's data processing device 15 to the display means, i.e. to the headup display 23.

FIG. 8 shows an example of a possible organizational structure of the central data collection site 20. A great variety of operations can be performed in the central data collection site 20. The functional block Computing 20A denotes the necessary computing operations in respect of the transmitted operating parameters for generating data records DS1-DSn derived therefrom. The functional block ID Recognition 20H represents the assignment of the individual IDs of the received data. Data are stored in the storage device 20B. The functional block Content Management 20I enables data such as, for example, additional information, to be fed into the system from outside. The functional blocks Monitoring 20C and Run-time Management 20J represent the monitoring of the operating parameters, or the operation of the run-time system, or real-time system. The functional block Service Management 20D contains measures relating to servicing work that is necessary in view of the transmitted operating data. The functional block User Data Management 20K relates to the management of the individual user data such as, for example, name, address, email address, mobile telephone number, etc.

The functional block Network 20F relates to the handling of network matters. The functional block User Info Management 20L relates to the compiling of information transmitted back from the central data collection site 20 to the individual users. The functional block Communication Management 20G relates to the handling of communication measures, such as selection of the transmission protocols, etc. The functional block Experience Database 20M relates to the receiving and maintenance of user-specific information, which, in turn, can be retrieved by other users.

According to a further expedient development of the invention, shown in FIG. 9, the operating data and/or operating parameters and/or data records derived therefrom, thus, for example, the charge state of the energy source, etc., can also be displayed directly, i.e. without being routed via the network 21, on a display 23 assigned to the work appliance or rescue appliance, e.g. a headup display and/or a display 23 disposed directly on the appliance 1, and/or on a display 23 taken along by the user. For this purpose, the data may be transmitted by wireless communication, preferably by short-range wireless communication means 24, from the work appliance or rescue appliance 1 directly to the display 23.

The present invention enables individual appliances, used in a great variety of deployment locations, to be monitored with precision in respect of their use and analyzed fully, in a very simple manner. This, in turn, enables unforeseen delays in the deployment of rescue appliances to be precluded in a reliable manner. The invention therefore contributes very significantly to improvement of the deployment conditions of rescue appliances.

LIST OF REFERENCES

1 rescue appliance
2 tool inserts
3 housing
3*a* receiving slot for energy source
4 electric motor
5 pump
6 energy source
6*a* housing, energy source
6*b* housing projection, energy source
6*c* holding clip, energy source
6*d* data carrier/data storage device
6*e* electrical contact region, energy source
7 main switch
8 charging device
8*a* receiving slot
8*b* wireless communication module
8*c* charging cable
8*d* processor
9 transmitting/receiving means (e.g. modem)
10 data interface
11 cylinder
12 switching valve
13 carrying handle
14 handle
15 data processing device
16 processor
16A data logger
17 GPS module
18 network provider
19 communication protocol
20 central data collection site
21 network (Internet)
22 mobile telephony network
23 display
ID1-IDn individual identity
S1-Sn sensor means
P1-Pn operating parameters
DS1-DSn data records

The invention claimed is:

1. A method for operating electrohydraulic rescue equipment, comprising:
two movable tool inserts for a cutting operation;
a housing;
a hydraulic cylinder;
an electric motor;
a pump driven by the electric motor, delivering hydraulic fluid to the hydraulic cylinder for actuating the tool insert;
an exchangeable, rechargeable electrical energy source, which is accommodated in or on the rescue equipment and has a dedicated housing; the method comprising:
detecting operating data during operation of the rescue equipment,
transferring the operating data into a data carrier or data memory accommodated in the electrical energy source,
removing the electrical energy source from the rescue equipment and connected to a charger,
reading the operating data stored in the data carrier or data memory of the electrical energy source by the charger and forwarding to a network and
the operating data being operation parameters and/or data sets derived therefrom,
wherein
the operating parameters are current presently drawn by the electric motor and inclination of the rescue equipment in space, and
providing the detected operating parameters with a time stamp, so that a temporal relation between the detected operating parameters is established,
compiling an actuation profile and/or load profile of the rescue equipment over time from the current drawn by the electric motor and the inclination of rescue equipment.

2. The method according to claim 1, wherein data and/or programs are transmitted via the network to the charger, the data and/or programs are transferred into the data carrier or data memory of the electrical energy source,
the electrical energy source is removed from the charger and connected to the rescue equipment, and
the data and/or programs are transferred from the electrical energy source into the rescue equipment.

3. The method according to claim 1, wherein the rescue equipment has an equipment-specific electronic ID, and
the equipment-specific electronic ID is an integral part of the operating data.

4. The method according to claim 3, wherein the operating parameters are detected with a time reference.

5. The method according to claim 1, wherein the following operating parameters comprise:
current drawn by the electric motor; and/or
electrical voltage; and/or
acceleration of the rescue equipment; and/or
charge state of the electrical energy source; and/or
number of charging cycles of the electrical energy source that have taken place; and/or
ambient temperature; and/or
ambient moisture; and/or
GPS position coordinates; and/or
time, or GPS time.

6. The method according to claim 1, wherein the operating data and/or operating parameters and/or data sets derived therefrom; further processed and/or stored and/or evaluated in a central data collection point accessible via the network.

7. The method according to claim 6, wherein the data set is generated based on the operating parameters in the central data collection point.

8. The method according to claim 7, wherein a knowledge base is generated, in which rescue equipment-specific pieces of information can be entered and/or retrieved by users, the knowledge base being generated so users of the rescue equipment add information data to the knowledge base and the knowledge base is retrievable by users.

9. The method according to claim 6, wherein a calculational evaluation of the operating parameters in the central data collection point takes place by a comparison of the received operating parameters with the data of an empirical operating-parameter database.

10. The method according to claim 6, wherein an equipment-specific operating history of the respective rescue equipment including the individual identity is generated and/or stored in the data collection point on the operating parameters.

11. The method according to claim 1, wherein pieces of information are transmitted from the central data collection point to the individual rescue equipment.

12. The method according to claim 11, wherein the pieces of information are displayed on a user-side data processing device.

13. The method according to claim 1, wherein the data exchange between the charger and the network takes place by radio.

14. The method according to claim 1, wherein the operating data and/or operating parameters and/or data sets derived therefrom are directly displayed on a display associated with the rescue equipment.

15. An electrohydraulic rescue equipment, which can be carried by one operator and used autonomously, comprising:

two movable tool inserts for a cutting, spreading or lifting operation;

a housing;

a hydraulic cylinder;

an electric motor;

a pump driven by the electric motor delivering hydraulic fluid to the hydraulic cylinder for actuating the tool insert;

an exchangeable, rechargeable electrical energy source, which is accommodated in or on the rescue equipment and has a dedicated housing;

at least one sensor device for detecting usage data of the rescue equipment during use; and a processor comprising a data logger, which is connected to the sensor device and detects measurement values of the sensor device or data derived therefrom and keeps the measurement values or data derived therefrom available for further processing, the energy source including a data carrier or data memory in which usage data of the sensor device is stored, wherein the sensor devices provided are a current sensor, which detects current presently drawn by the electric motor, and an inclination sensor, which detects inclination of the rescue equipment in space, current presently drawn by the electric motor and orientation of the rescue equipment are provided with a time stamp, and a temporal relation being established between the parameters.

16. The rescue equipment according to claim 15, wherein a, data interface is provided between the rescue equipment and the energy source.

17. The rescue equipment according to claim 15, wherein the individual rescue equipment has an individually associated electronic ID.

18. The rescue equipment according to claim 15, wherein the sensor devices provided are a voltage sensor: and/or a temperature sensor; and/or a battery charge state sensor; and/or a battery charge cycle counter; and/or a moisture sensor; and/or a GPS module; and/or a time measuring element.

19. The rescue equipment according to claim 15, further comprising a display associated with the rescue equipment.

* * * * *